US011097935B2

(12) United States Patent
Renner

(10) Patent No.: US 11,097,935 B2
(45) Date of Patent: Aug. 24, 2021

(54) TRANSITIONAL ELECTRIC CAN OPENER

(71) Applicant: Hamilton Beach Brands, Inc., Glen Allen, VA (US)

(72) Inventor: Katherine E Renner, Morristown, NJ (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 120 days.

(21) Appl. No.: 16/393,643

(22) Filed: Apr. 24, 2019

(65) Prior Publication Data

US 2019/0352159 A1 Nov. 21, 2019

Related U.S. Application Data

(60) Provisional application No. 62/667,739, filed on May 7, 2018.

(51) Int. Cl.
*B67B 7/00* (2006.01)

(52) U.S. Cl.
CPC ..... *B67B 7/38* (2013.01)

(58) Field of Classification Search
CPC ..... B67B 7/38; B67B 7/385
See application file for complete search history.

(56) References Cited

U.S. PATENT DOCUMENTS 4,561,182 A * 12/1985 Yamamoto ..... B67B 7/38 30/400
4,663,849 A * 5/1987 Nickelson ..... A47B 77/12 248/324
5,313,708 A * 5/1994 Edwards ..... B67B 7/38 30/417
5,664,333 A * 9/1997 Hardman ..... B67B 7/38 30/400

* cited by examiner

*Primary Examiner* — Andrew M Tecco
*Assistant Examiner* — Nicholas E Igbokwe
(74) *Attorney, Agent, or Firm* — Alexander D. Raring

(57) ABSTRACT

An electric can opener comprises an upper opening portion and lower base portion. The upper opening portion and the lower base portion are selectively attachable to and separable from each other. The upper opening portion and the lower base portion are operable as an upright countertop can opener when attached, and the upper cutting portion is operable as a walk-and-cut can opener when separated from the lower base portion.

4 Claims, 17 Drawing Sheets

TRANSITIONAL ELECTRIC CAN OPENER

CROSS-REFERENCE TO RELATED APPLICATIONS

This application is a non-provisional of and claims priority to U.S. Provisional Patent Application Ser. No. 62/667,739, filed May 7, 2018, the contents of which are incorporated herein by reference in its entirety.

BACKGROUND OF THE DISCLOSURE

The present disclosure relates generally to small appliances, and more particularly to electric can openers.

Electric can openers are a common household appliance and are capable of removing the top off a metal can. There are two main types of electric can openers—traditional countertop can openers and walk-and-cut can openers. Both types of electric can openers cut the lid away from the inside of the can. As seen in FIG. 1, a countertop can opener 10 comprises a relatively tall housing 12 that sits on the countertop, providing a stable base for the device. At the top of the housing, the cutting assembly comprises a handle 14 that, when pushed down by a user, lowers a blade 16 and thereby causes the blade 16 to pierce the lid of a can. The lid typically "holds" the blade in place, thereby supporting the can. A drive wheel 18 is rotated by an electric motor (not illustrated) within the housing, thereby rotating the can so that the lid is cut. The motor is powered via a power cord (not illustrated) plugged into an AC household electrical outlet. A magnet 20 attracts the cut lid to keep the lid from falling into the contents of the can.

Countertop can openers have a relatively tall housing to enable cans of a variety of heights to be opened. In this regard, typical countertop can openers are able to open most common can sizes. However, typical countertop can openers are not tall enough to open all can sizes (such as #10 cans) as most consumers do not want to have a can opener that is tall enough to open as cans as such extra tall can openers would be unsightly and are less regularly needed.

Walk-and-cut can openers are smaller, battery-powered devices that are able to open any size can because walk-and-cut can openers sit on top of the can and rotate about the can during operation. As seen in FIG. 2, a walk-and-cut can opener 30 comprises a relatively small housing 32 that is readily portable. At the top of the housing, the cutting assembly comprises a handle 34 that, when pushed down by a user, lowers a blade 36 and thereby causes the blade 36 to pierce the lid of a can. A drive wheel 38 is rotated by an electric motor (not illustrated) within the housing, thereby moving the walk-and-cut can opener 30 about the can so that the lid is cut. A magnet 40 attracts the cut lid to keep the lid from falling into the contents of the can. The motor is powered via batteries (not illustrated) contained within the housing 32, and therefore a walk-and-cut can opener does not need to be plugged into an AC household electrical outlet. However, as with all battery-powered devices, a user of a walk-and-cut can opener will sometimes find that the batteries have run down and need to be replaced. Having to replace the batteries is a recurring expense, and may happen at inconvenient times.

It has heretofore not been discovered how to create an electric can opener that provides a reasonably compact form factor, that is able to open any size can, and that seldom (if ever) needs to have batteries replaced. The electric can opener of the following disclosure overcomes at least one of the above-described disadvantages of conventional electric can openers.

BRIEF SUMMARY OF THE DISCLOSURE

A transitional electric can opener is disclosed herein. In one embodiment of the subject device, an electric can opener comprises an upper opening portion and lower base portion. The upper opening portion and the lower base portion are selectively attachable to and separable from each other. The upper opening portion and the lower base portion are operable as an upright countertop can opener when attached, and the upper cutting portion is operable as a walk-and-cut can opener when separated from the lower base portion.

The upper opening portion may comprise a motor and one or more batteries to selectively power the motor. The lower base portion may selectively provide electrical power to the upper opening portion to charge the one or more batteries. The lower base portion may selectively provide electrical power to the upper opening portion via corresponding electrical contacts in the upper opening portion and in the lower base portion. The lower base portion may comprise an AC power cord and an AC-to-DC converter to provide DC electrical power to the upper opening portion.

The electric can opener may further comprise one or more latches for selectively securing the upper opening portion to the lower base portion.

In alternative embodiments of the present disclosure, an electric can opener comprises an upper opening portion and an upright base. The upper opening portion comprises a motor, one or more batteries to power the motor, a drive wheel, and a cutting blade. The upper opening portion is selectively attachable to and separable from a top end of the upright base.

The upper opening portion and the upright base may be operable as an upright countertop electric can opener when attached, and the upper cutting portion may be operable as an electric walk-and-cut can opener when separated from the upright base.

The upright base may selectively provide electrical power to the upper opening portion to charge the one or more batteries. The upright base may selectively provide electrical power to the upper opening portion via corresponding electrical contacts in the upper opening portion and in the upright base. The upright base may comprise an AC power cord and an AC-to-DC converter to selectively provide DC electrical power to the upper opening portion.

The electric can opener may further comprise one or more latches for selectively securing the upper opening portion to the upright base.

Other alternative embodiments of the invention comprise a method of opening different sized cans. The method comprises (a) attaching an upper opening portion of an electric can opener to an upright base, the upper opening portion comprising an activation handle, a motor, one or more batteries to power the motor when the activation handle is moved to an activation position, a drive wheel, and a cutting blade; (b) attaching a first sized can to the upper opening portion; (c) moving the activation handle to the activation position; (d) removing the first sized can from the upper opening portion; (e) separating the upper opening portion from the upright base; (f) attaching the upper opening portion to a second sized can, the second sized can having a different size than the first sized can; (g) moving the activation handle to the activation position; and (h) removing the upper opening portion from the second sized can.

The upright base may provide electrical power to the upper opening portion to charge the one or more batteries when the upper opening portion is attached to the upright base. The upright base may provide electrical power to the upper opening portion via corresponding electrical contacts in the upper opening portion and in the upright base.

The upright base portion may comprise (a) one or more latches selectively engageable with corresponding latch holes in the upper opening portion for selectively securing the upper opening portion to the upright base and (b) a detach button for moving the one or more latches from a latching position to an unlatching position. The method may further comprise depressing the detach button before separating the upper opening portion from the upright base.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
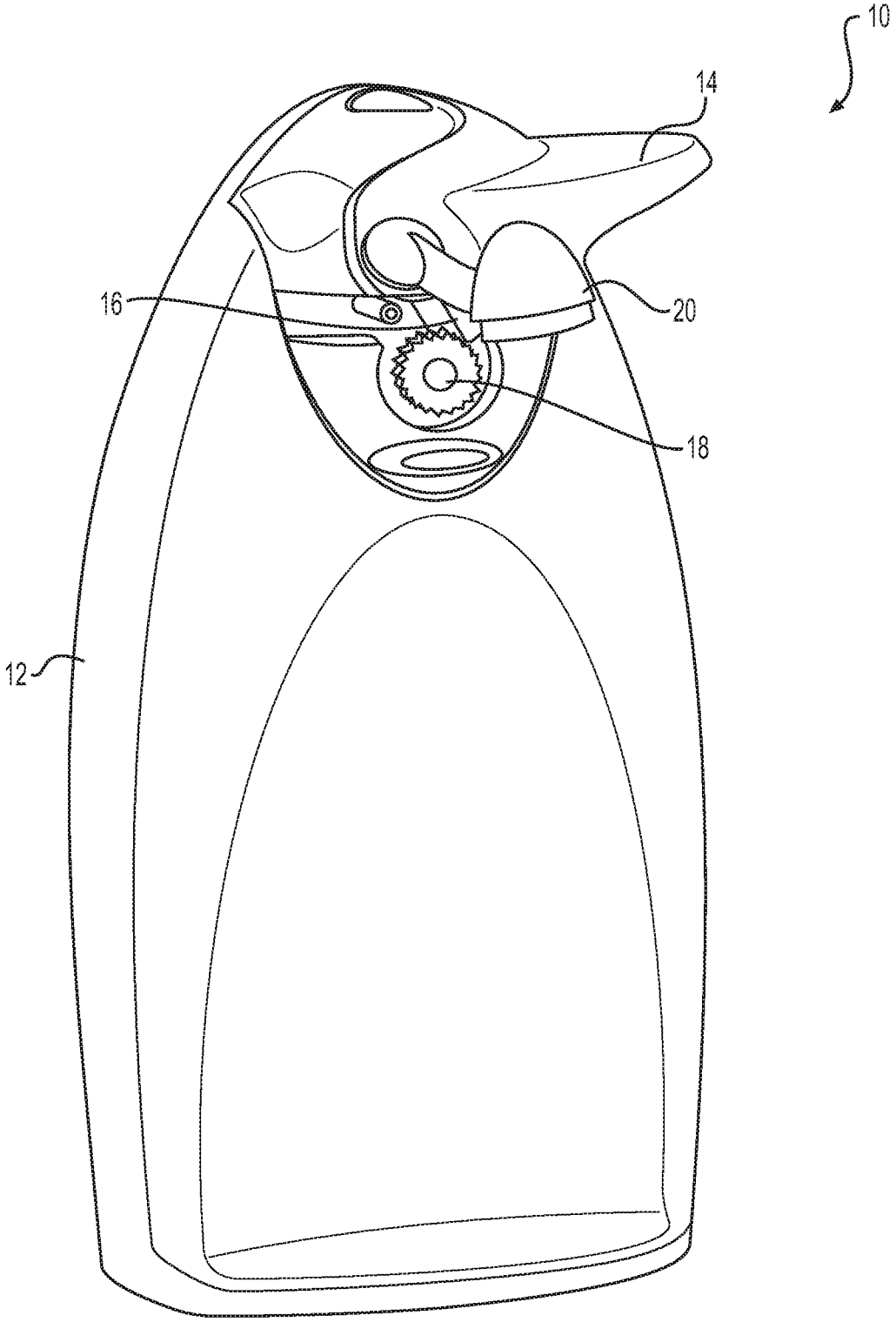
FIG. 1 (PRIOR ART)
FIG. 1 is a perspective view of a prior art electric can opener.
Figure 2:
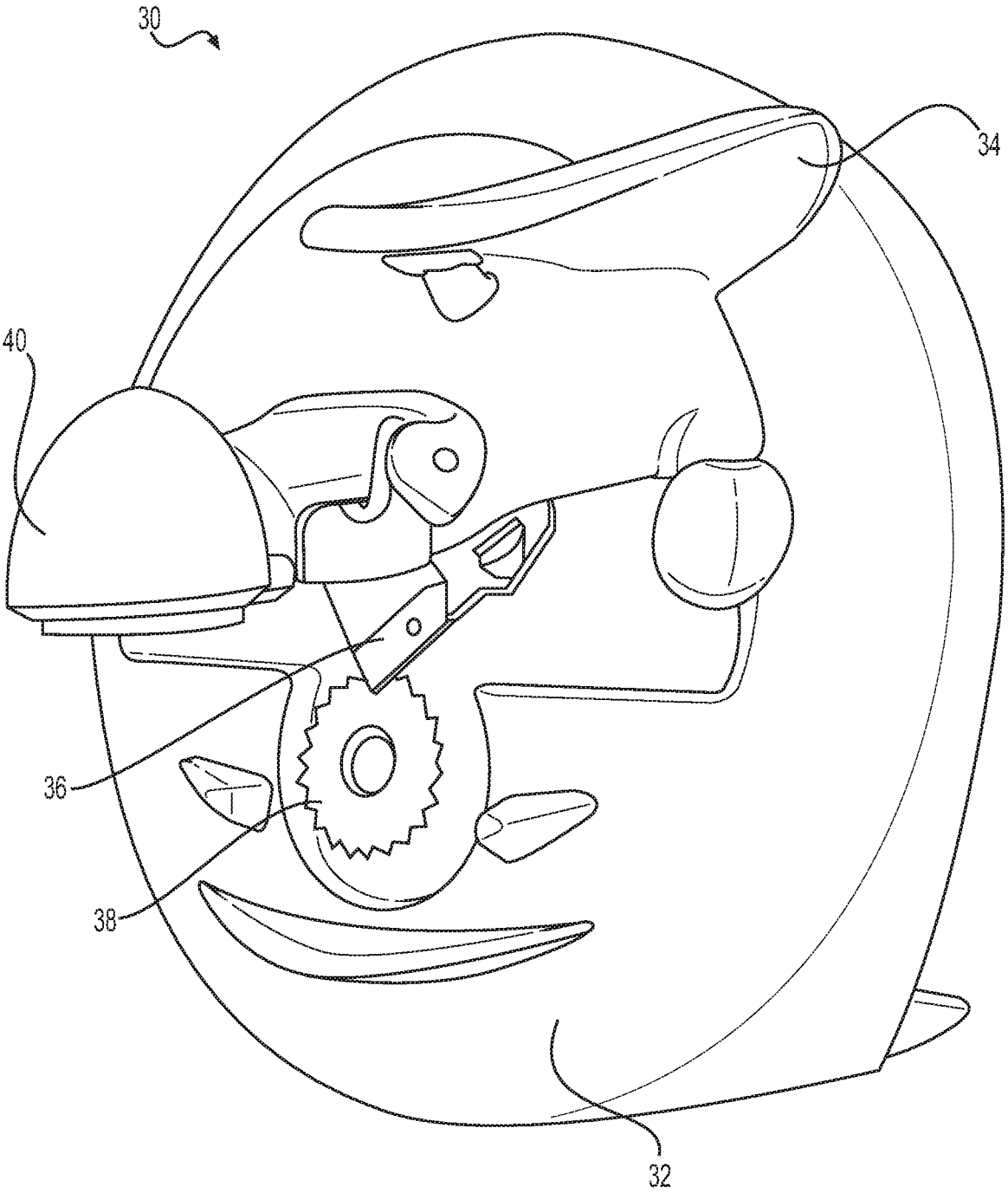
FIG. 2 (PRIOR ART)
FIG. 2 is a perspective view of another prior art electric can opener.
Figure 3:
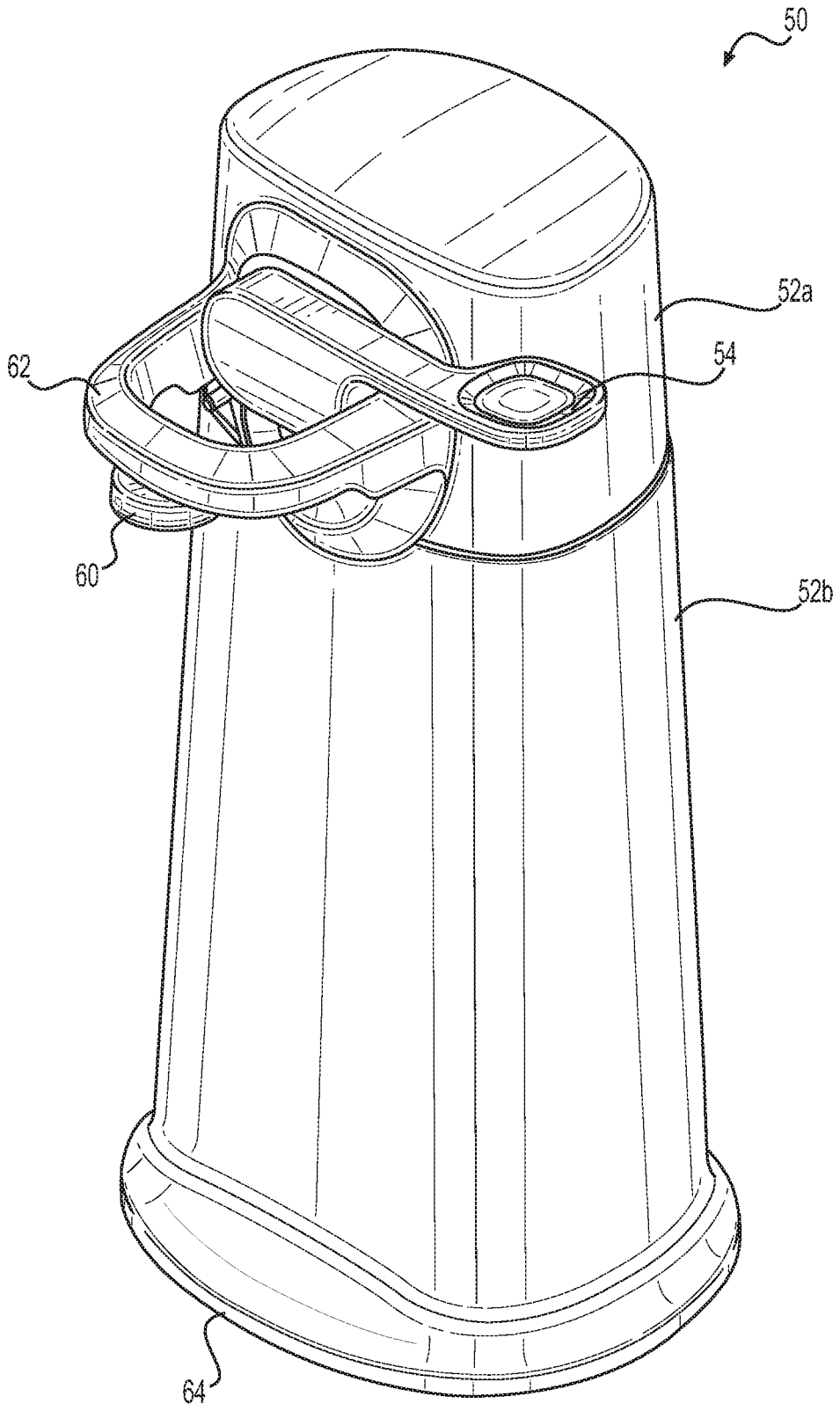
FIG. 3 is a perspective view of an electric can opener, according to one embodiment of the present disclosure.
Figure 4:
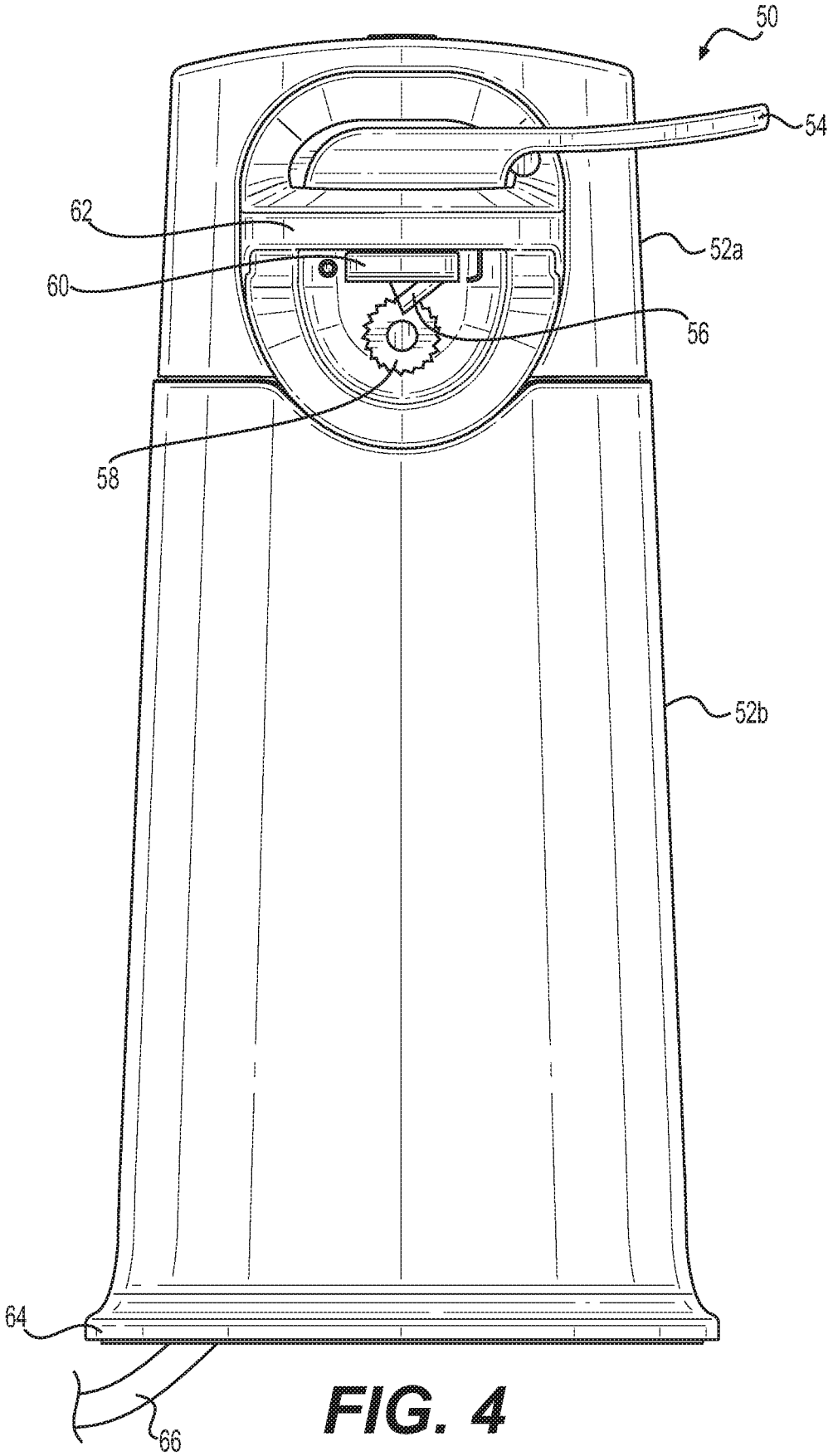
FIG. 4 is a front view of the electric can opener of FIG. 3.
Figure 5:
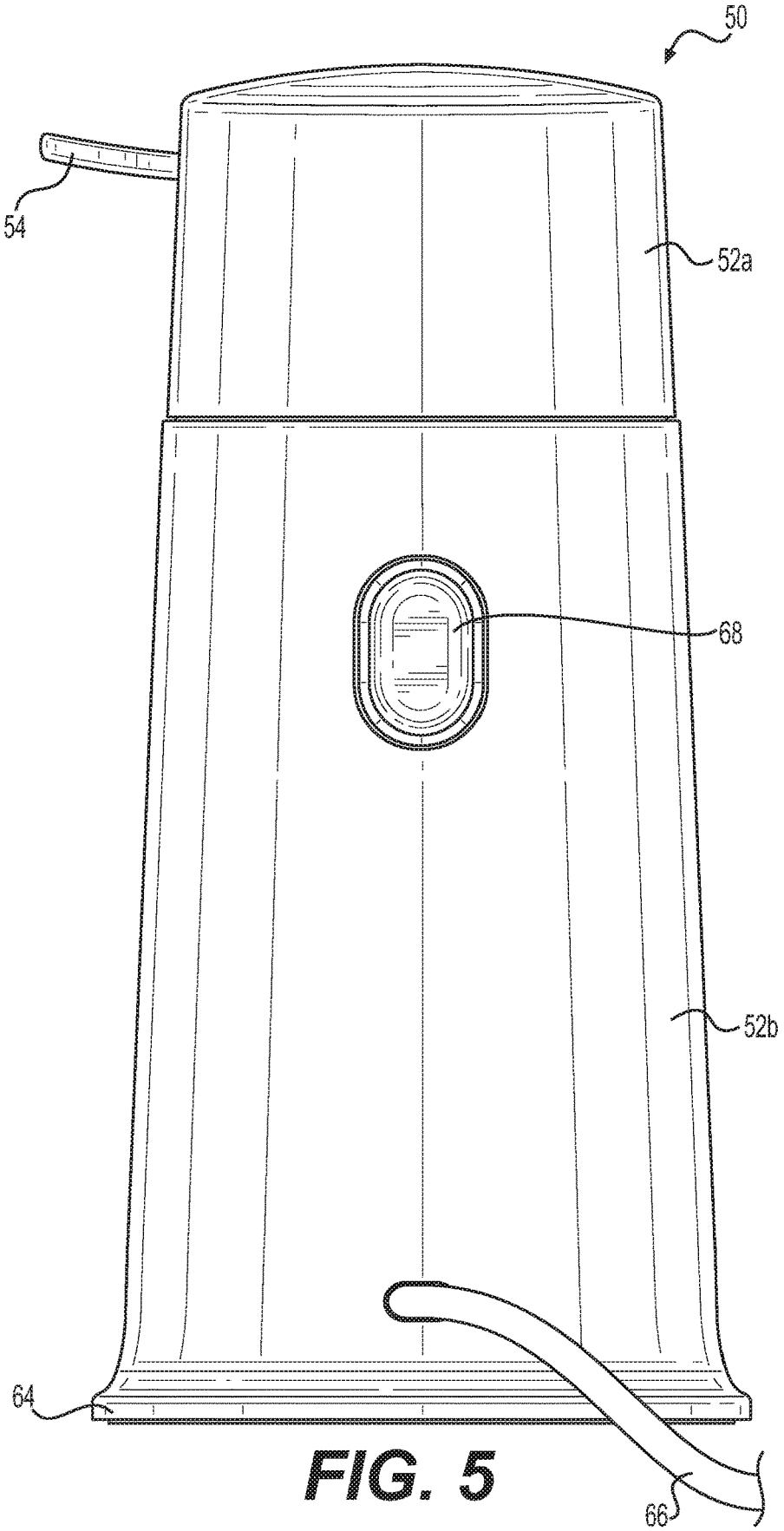
FIG. 5 is a rear view of the electric can opener of FIG. 3.
Figure 6:
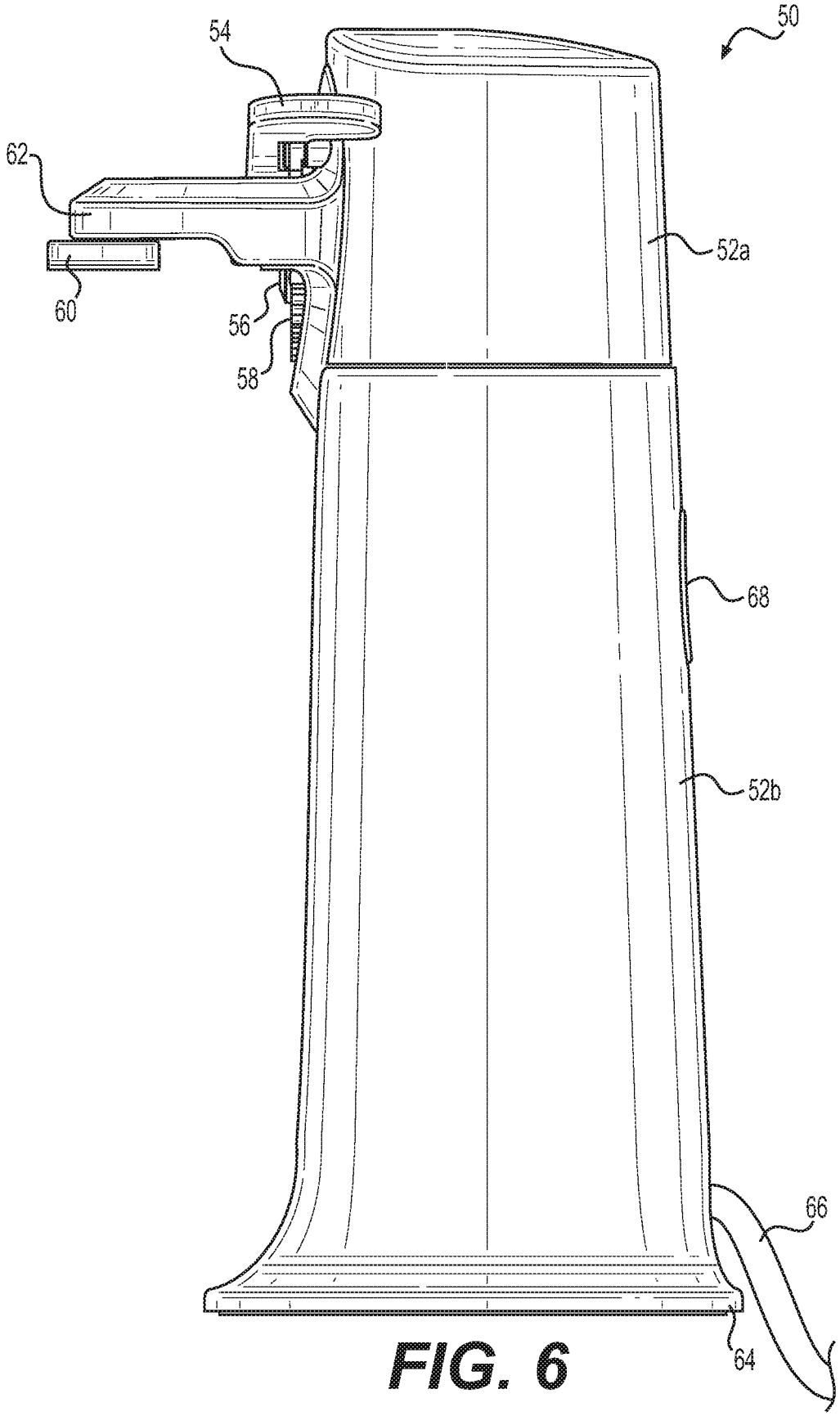
FIG. 6 is a right side view of the electric can opener of FIG. 3.
Figure 7:
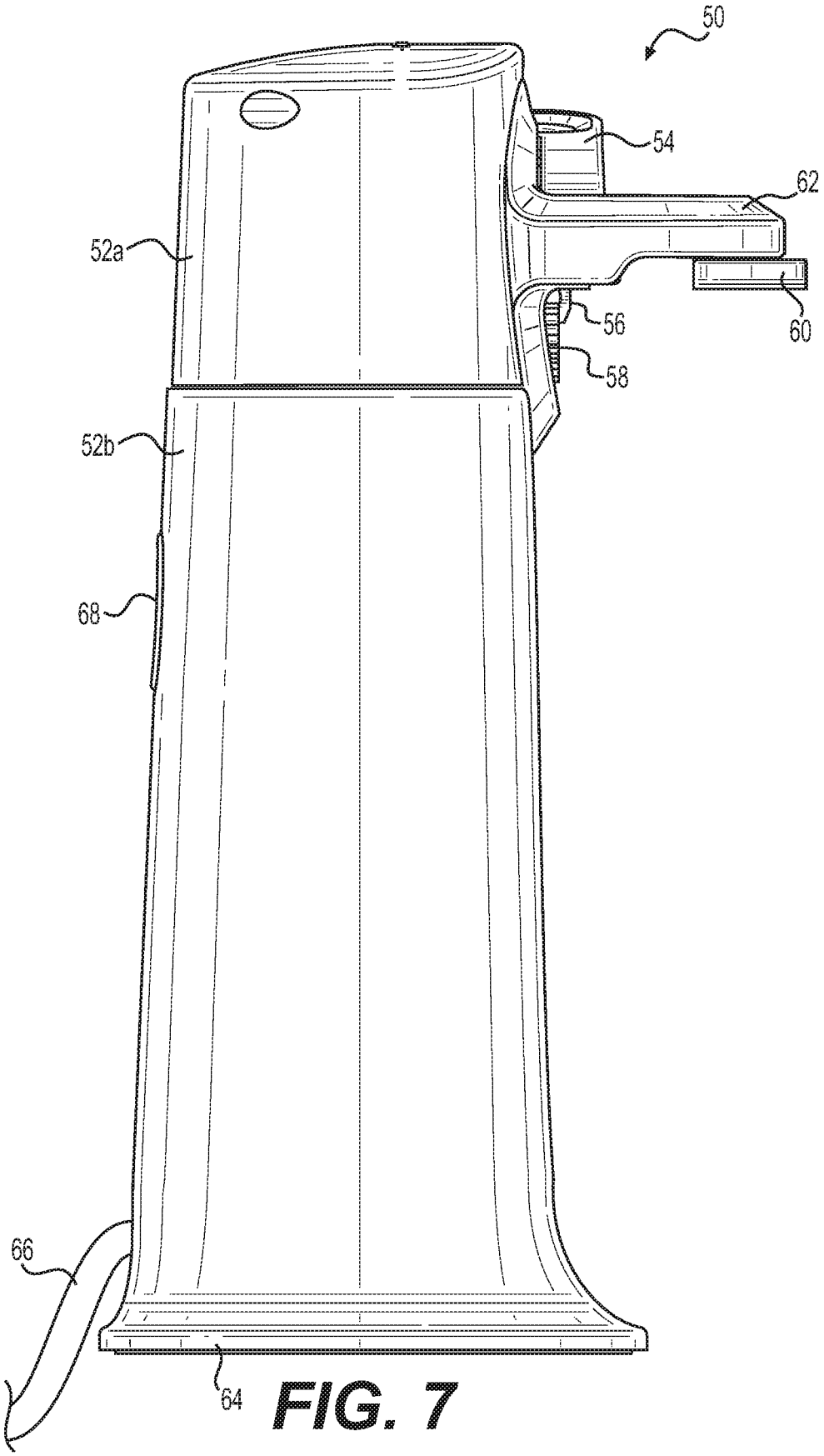
FIG. 7 is a left side view of the electric can opener of FIG. 3.
Figure 8:
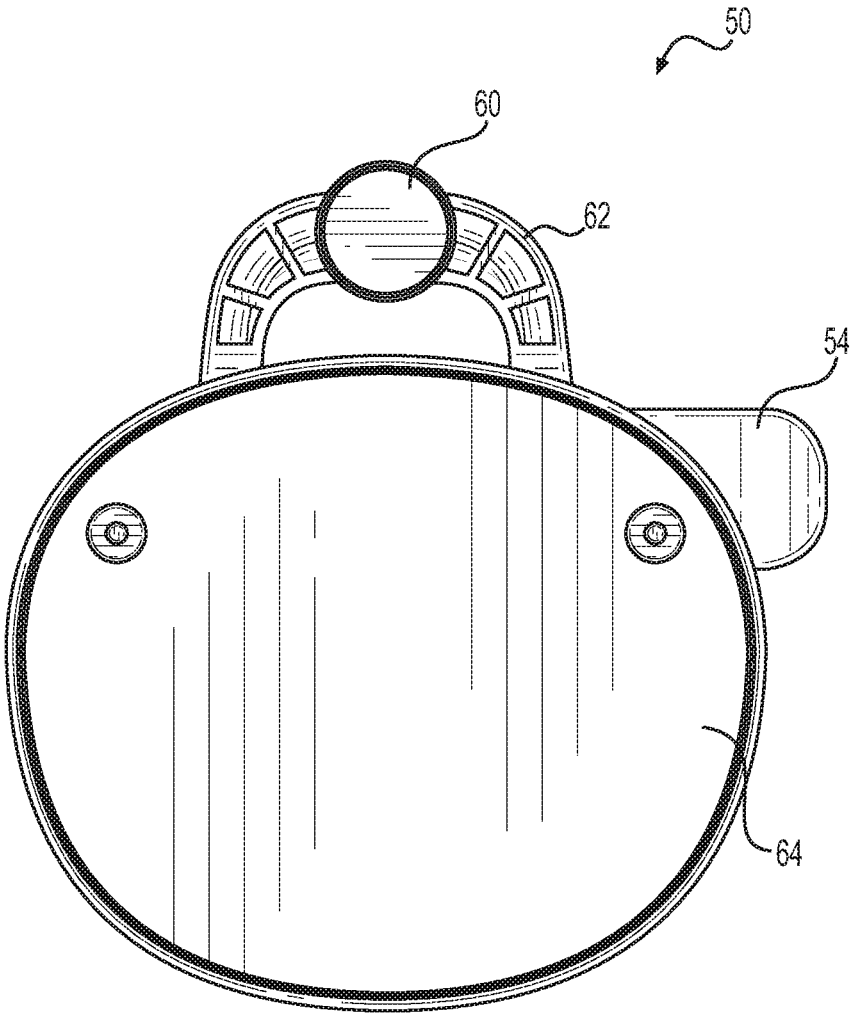
FIG. 8 is a bottom view of the electric can opener of FIG. 3.
Figure 9:
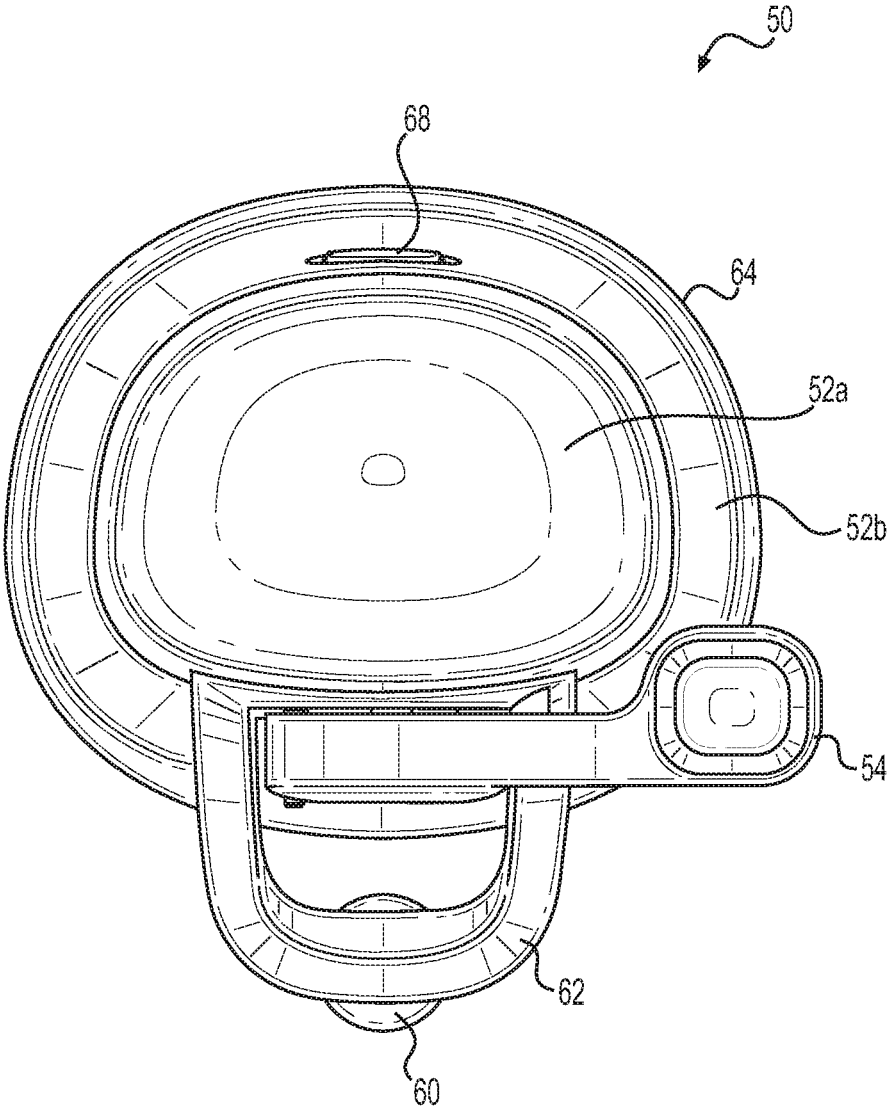
FIG. 9 is a top view of the electric can opener of FIG. 3.
Figure 10:
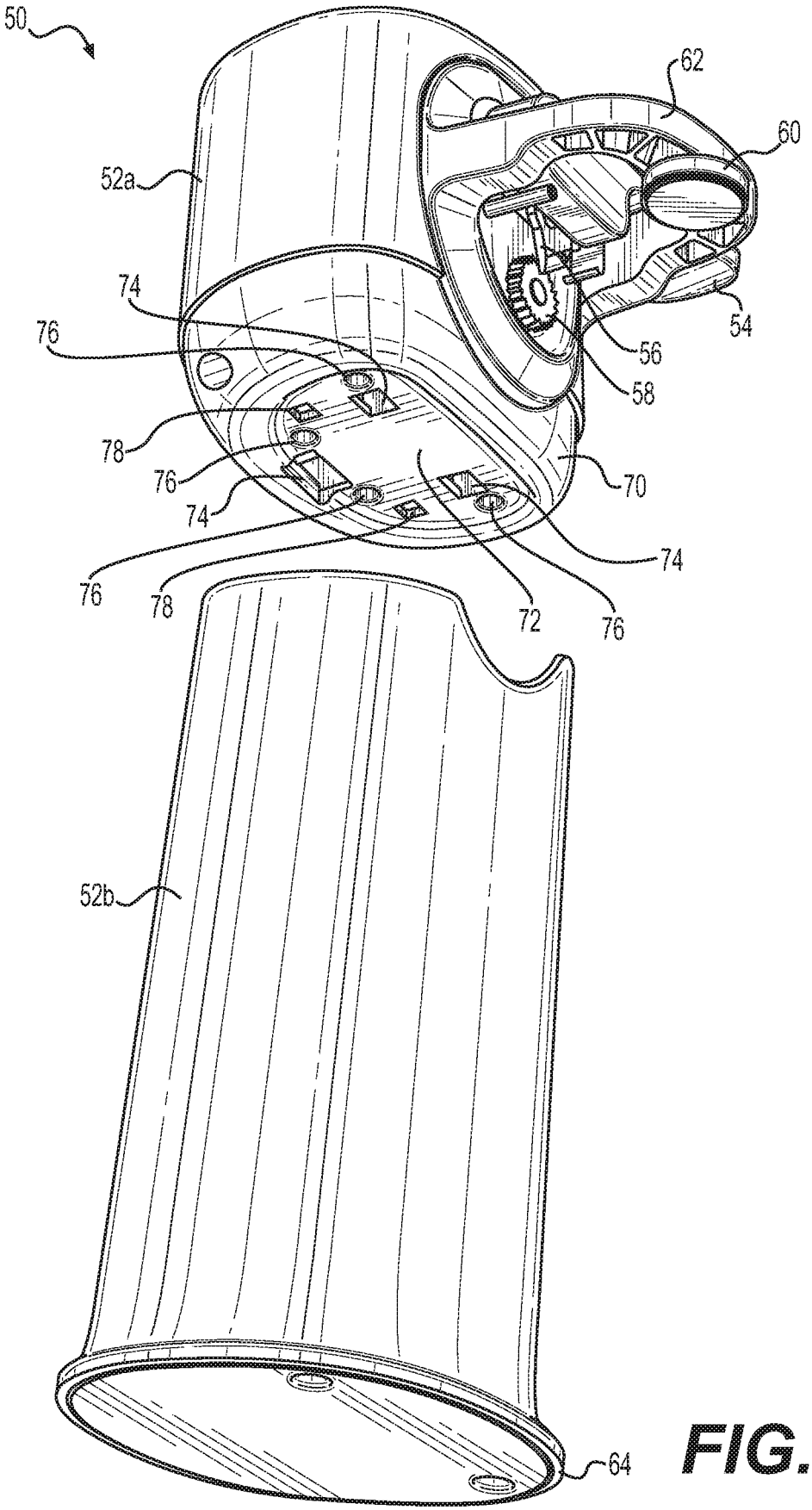
FIG. 10 is a perspective view from the bottom and left of the electric can opener of FIG. 3 in a separated arrangement.
Figure 11:
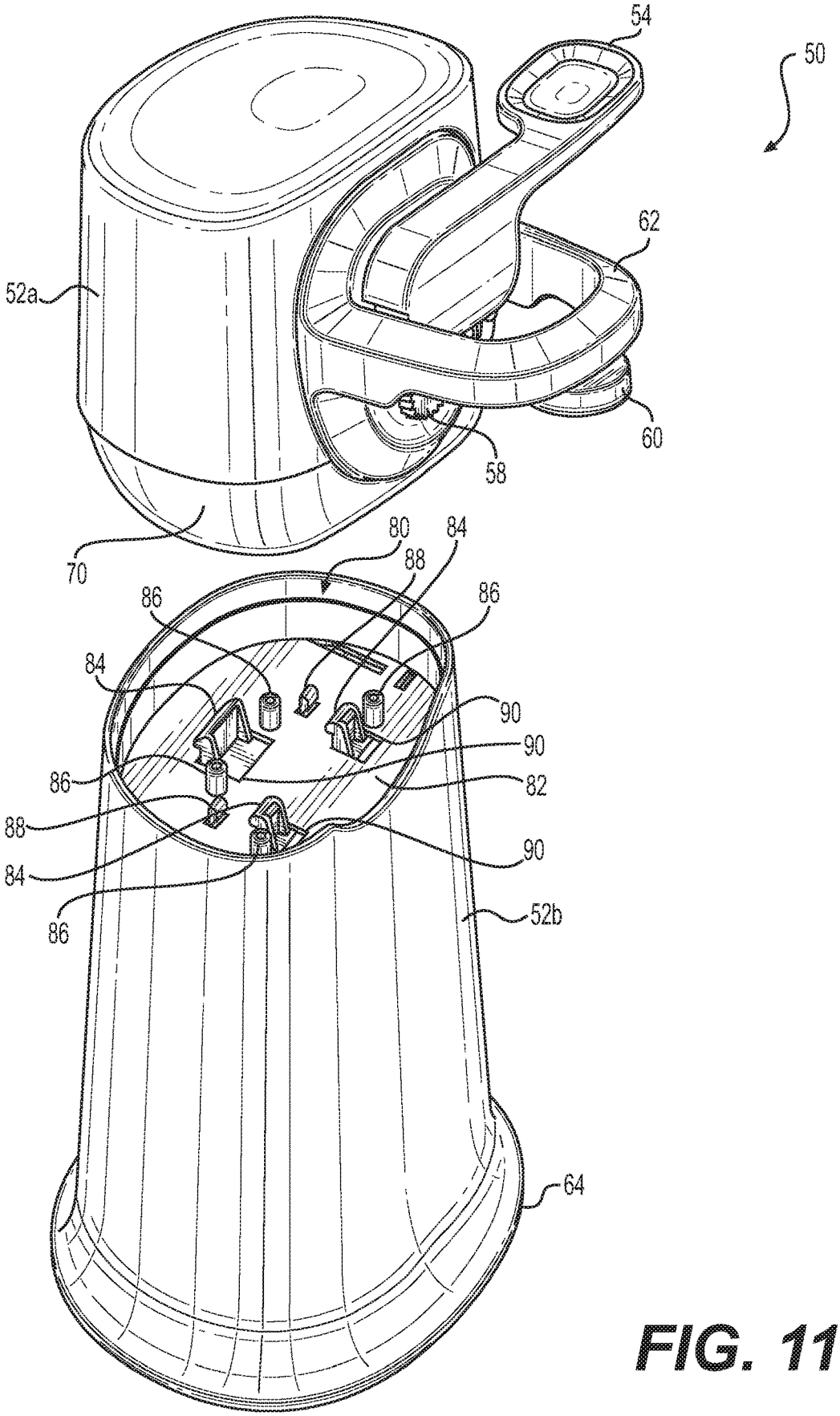
FIG. 11 is a perspective view from the top and left of the electric can opener of FIG. 3 in a separated arrangement.
Figure 12:
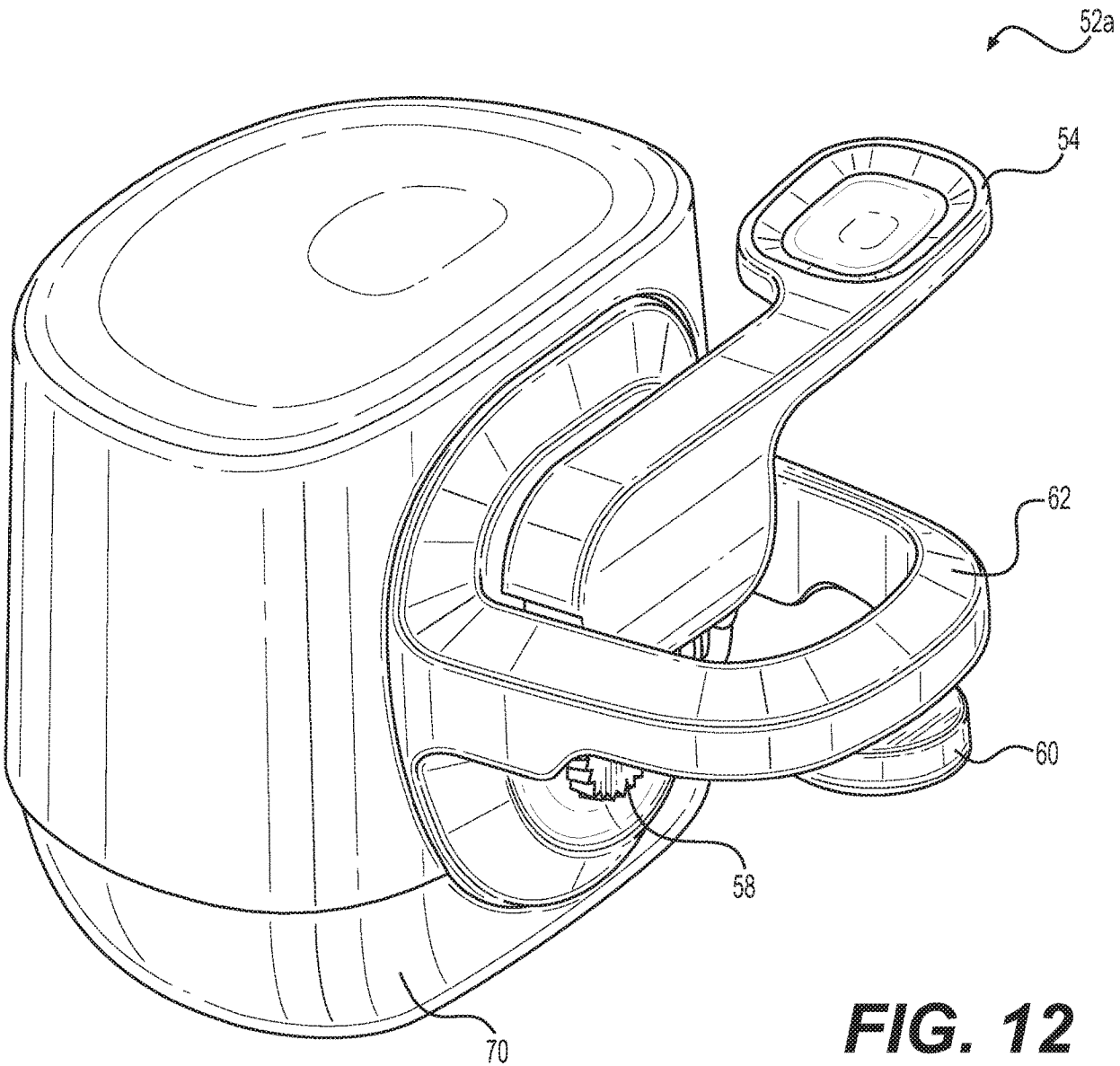
FIG. 12 is a perspective view from the top and left of the separated upper portion of the electric can opener of FIG. 3.
Figure 13:
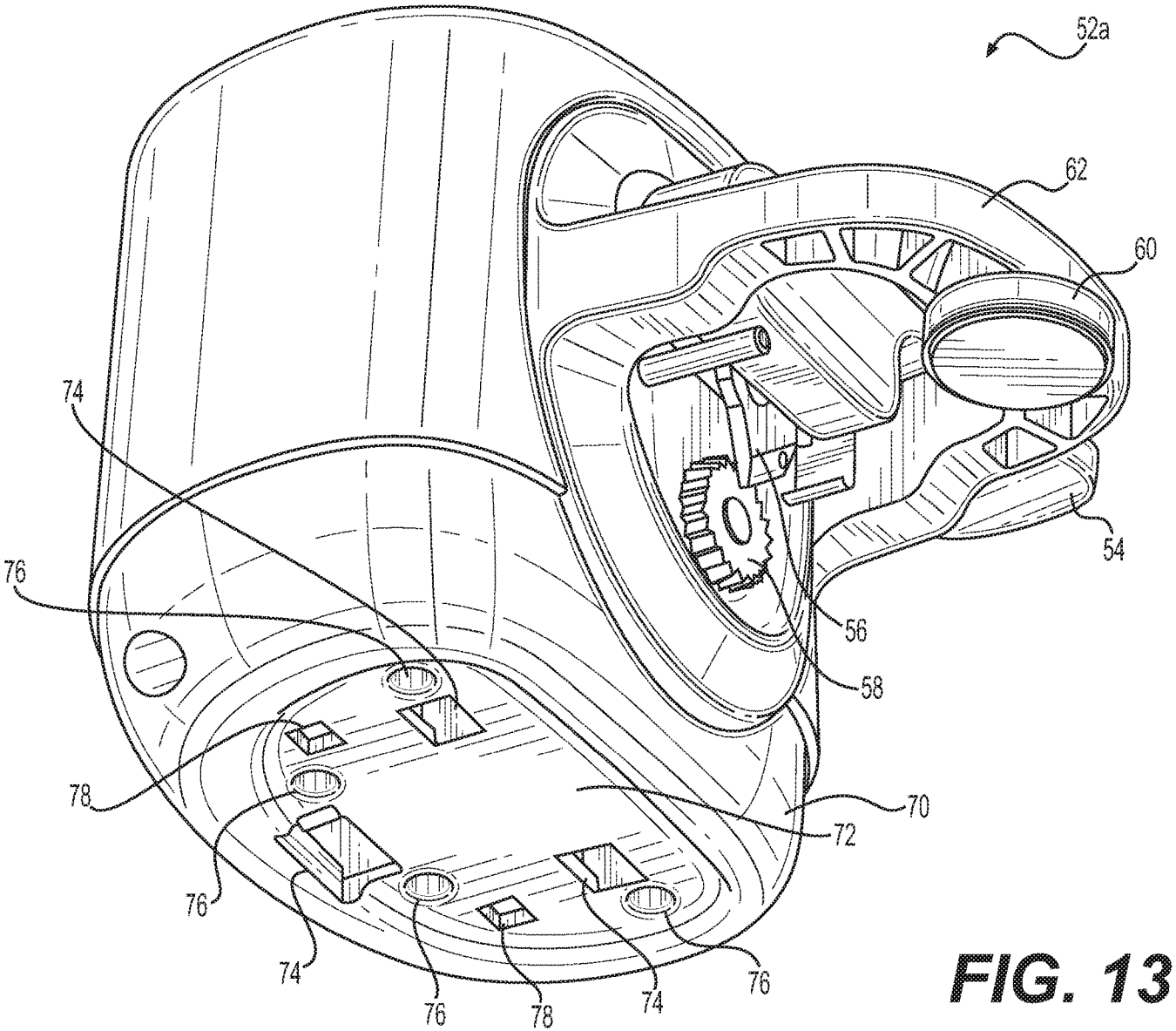
FIG. 13 is a perspective view from the bottom and left of the separated upper portion of the electric can opener of FIG. 3.
Figure 14:
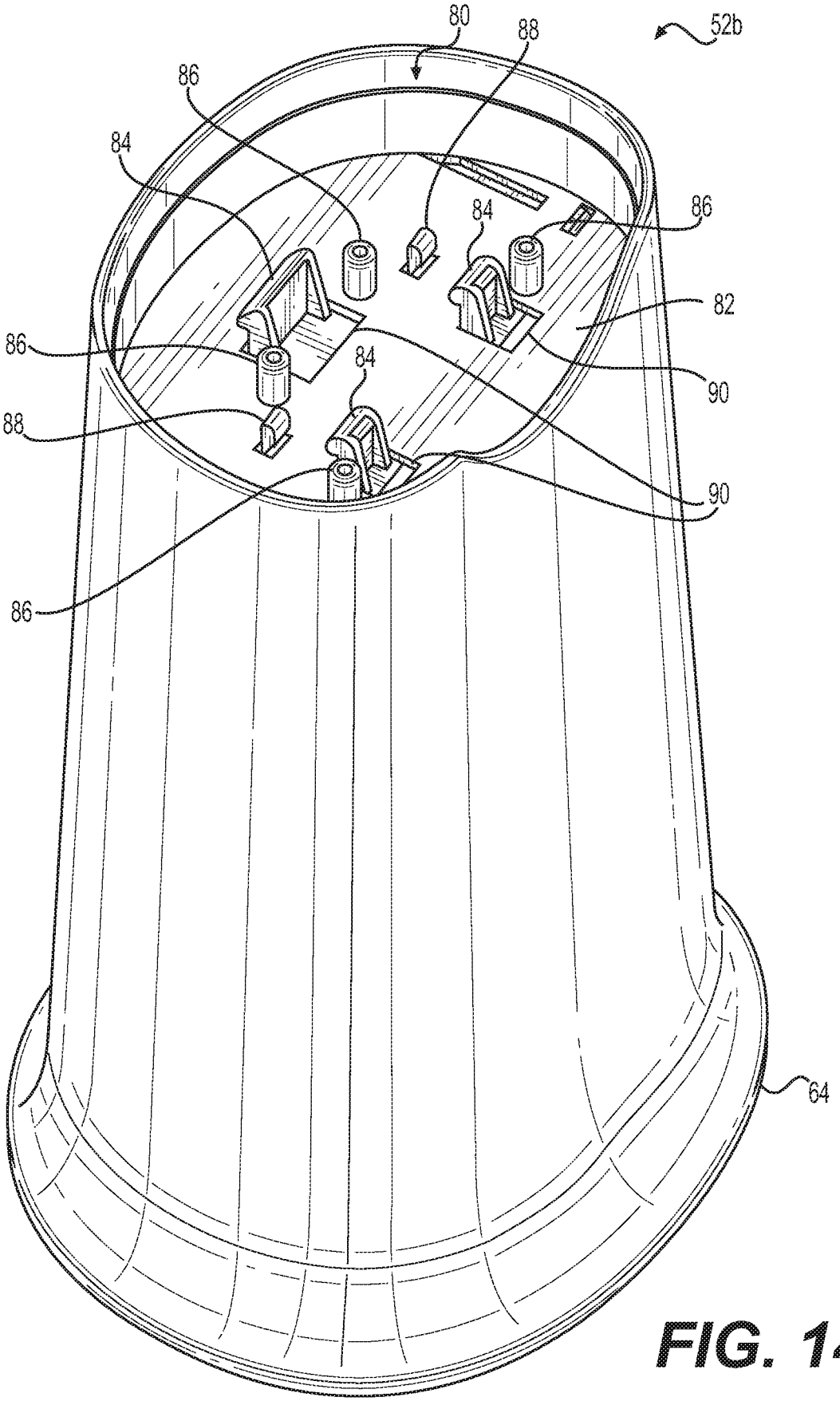
FIG. 14 is a perspective view from the top and left of the separated lower portion of the electric can opener of FIG. 3.
Figure 15:
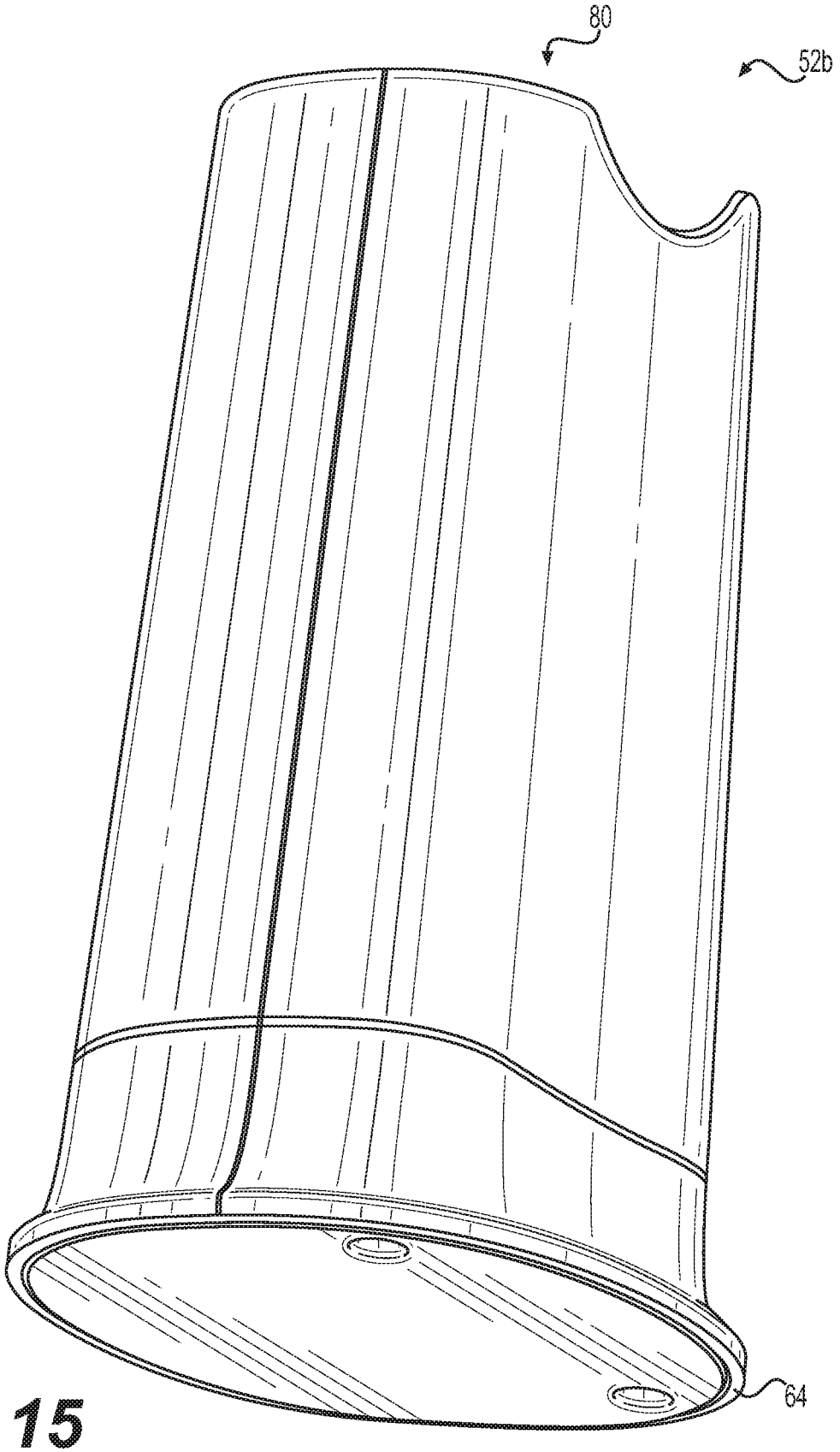
FIG. 15 is a perspective view from the bottom and left of the separated lower portion of the electric can opener of FIG. 3.
Figure 16:
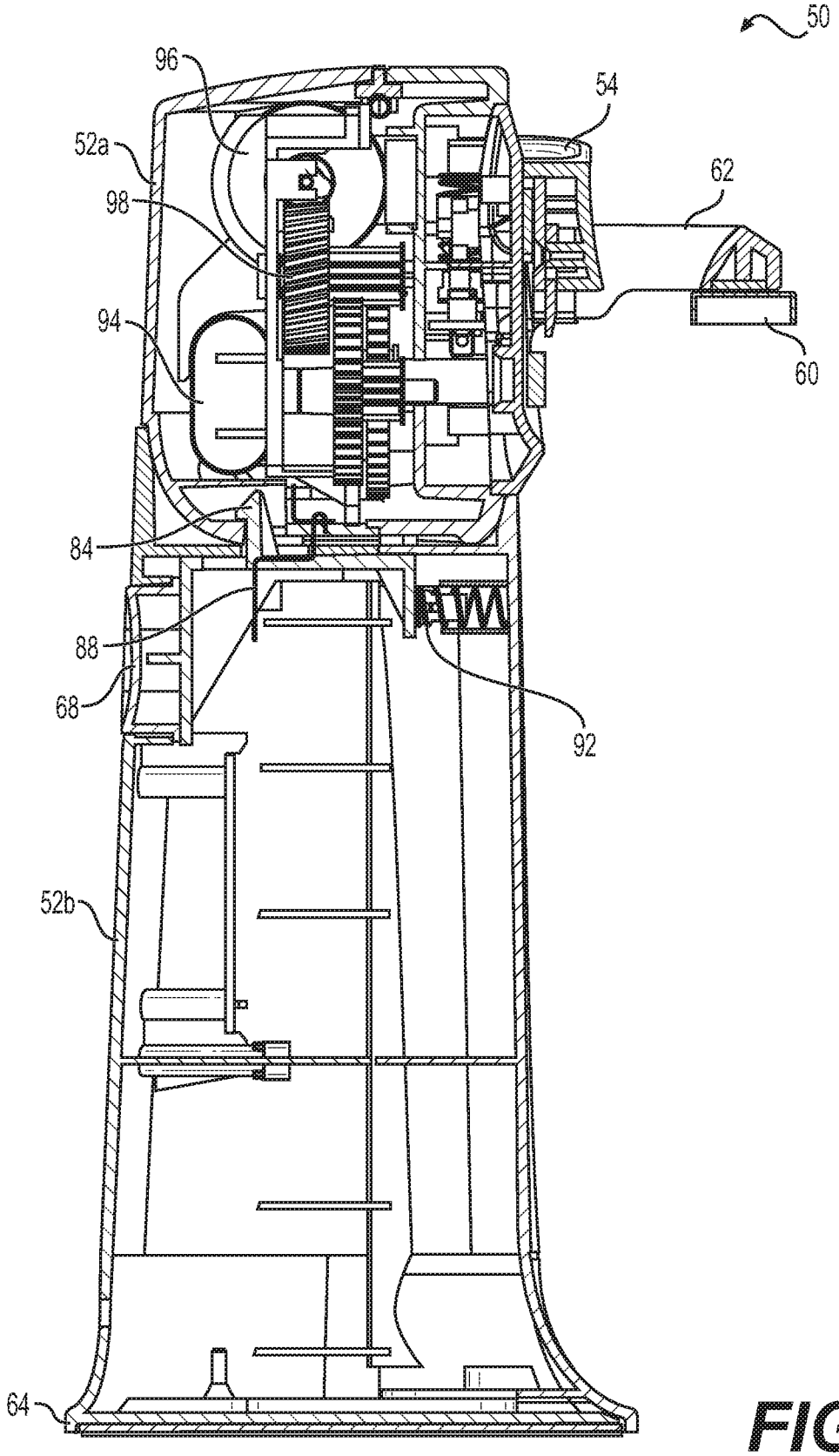
FIG. 16 is a cutaway/sectional left side view of the electric can opener of FIG. 3.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the present disclosure comprise an electric can opener having selectively separable upper and lower housing portions. When the upper and lower housing portions are engaged, the electric can opener of embodiments of the present disclosure looks and functions like a conventional countertop electric can opener. However, when the upper housing portion is separated from the lower housing portion, the upper housing portion looks and operates like a walk-and-cut can opener. In this regard, the electric can opener of embodiments of the present disclosure may be used to open any size can. The electric can opener of embodiments of the invention may be termed a transitional electric can opener, as the device is capable of transitioning between a countertop can opener and a walk-and-cut can opener.

Referring to the drawings in detail, wherein like numerals indicate like elements throughout, FIGS. 3-17 illustrate an electric can opener of embodiments of the present disclosure. The electric can opener 50 of embodiments of the present disclosure comprises an upper housing portion or head 52*a* and a lower housing portion or base 52*b*. The upper housing portion 52*a* comprises a handle 54 that, when pushed down by a user, lowers a blade 56 and thereby causes the blade 56 to pierce the lid of a can (not illustrated). A drive wheel 58 is rotated by an electric motor 96 within the upper housing portion 52*a* (the motor 96 rotates the drive wheel 58 via a drive train 98, the drive train typically comprises a plurality of gears or the like as is conventionally known), thereby rotating the can (when functioning as a countertop can opener) or moving the upper housing portion 52*a* about the can (when functioning as a walk-and-cut can opener) so that the lid is cut. A magnet 60 attracts the cut lid to keep the lid from falling into the contents of the can. The magnet 60 is supported in the desired location by a cantilevered arm 62 projecting outward from the upper housing portion 52*a*. The motor is powered via one or more batteries 94 contained within the upper housing portion 52*a*.

As illustrated in FIGS. 3-9, the electric can opener 50 functions as a countertop can opener when the upper and lower housing portions 52*a*, 52*b* are attached. As illustrated in FIGS. 10-15, the upper housing portion 52*a* is separable from and may be lifted off the lower housing portion 52*b*. The upper housing portion 52*a* of the electric can opener 50 functions as a walk-and-cut can opener when the upper housing portion 52*a* is separated from the lower housing portion 52*b*.

The lower housing portion 52*b* has a flat, relatively wide bottom 64 such that the lower housing portion 52*b* is adapted to sit on a countertop or other flat surface and support the upper housing portion 52*a* at a suitable height for opening a desired number of different can sizes (but typically not all can sizes) when functioning as a countertop can opener. Because the electric motor 96 and battery(ies) 94 must be in the upper housing portion thereby increasing the mass of the upper housing portion, additional mass (not illustrated) may be added to the lower housing portion to provide stability to the device when the upper and lower housing portions are joined.

Because the can is held and rotated by the upper housing portion (when the upper and lower housing portions are joined), the upper and lower housing portions should be securely (but removably) attachable to each other to prevent the housing portions from unintentionally detaching from each other. Any suitable mechanical attachment mechanism may be used to securely but removably attach the upper and lower housing portions, such as a sliding latch, one or more clips, or the like. Alternatively, it may be possible to use a friction or compression fit between the upper and lower housing portions.

The figures illustrate one possible attachment mechanism for selectively attaching and detaching the upper and lower housing portions 52, 52*b*. The upper housing portion 52*a* has a rounded bottom 70 that is selectively received relatively snugly into a cavity 80 at the top end of the lower housing portion 52*b*. To help ensure proper alignment between the upper and lower housing portions 52, 52*b* and to help prevent lateral movement between the upper and lower housing portions, one or more mating pins 86 (four are illustrated, but more or fewer may be used) may project upward from a floor 82 of the cavity 80 of the lower housing portion 52*b*. When the upper and lower housing portions 52, 52*b* are selectively attached, the mating pins 86 are received by corresponding mating holes 76 defined in a flat floor 72 of the upper housing portion 52*a*.

To hold the upper and lower housing portions 52, 52*b* together, one or more latches 84 (three are illustrated, but more or fewer may be used) may project upward through holes 90 defined in the floor 82 of the cavity 80 of the lower housing portion 52*b*. The holes 90 are larger than the latches 84 to enable lateral (front-back) movement of the latches when attaching and detaching the upper and lower housing portions 52, 52*b*. The latches 84 each have a lateral projection at the top to enable each latch 84 to selectively engage a corresponding hole 74 defined in the flat floor 72 of the upper housing portion 52*a*. The latches 84 move in unison toward the front of the device when a user depresses a detach button 68 on the back side of the lower housing portion 52*b* (the directional movement of the latches and the location of the detach button may vary) to disengage the latches 84 and enable the upper and lower housing portions to be detached. A spring 92 or similar biasing mechanism biases the latches 84 toward the rear of the device into the positions in which the latches 84 engage the corresponding holes 74. The top ends of each latch 84 may be rounded/angled as shown such that pushing the upper and lower housing portions 52, 52*b* together forces the latches 84 forward to enable the upper and lower housing portions to fully mate. In this regard, the detach button 68 typically does not need to be depressed to enable the upper and lower housing portions 52, 52*b* to be attached.

As the motor is powered via one or more batteries contained within the upper housing portion 52*a*, it may be desirable to provide the ability to charge the batteries. In this regard, the upper and lower housing portions 52*a*, 52*b* may contain the necessary components to charge the batteries when the upper and lower housing portions are attached to each other. The lower housing portion 52*b* may comprise a power cord that may be plugged into an AC household electrical outlet, a suitable AC-to-DC converter, and any suitable charging ports, contacts, or the like that would mate with corresponding charging ports, contacts, or the like on the upper housing portion 52*a* when the upper and lower housing portions are attached to each other. Any suitable charging mechanism may be used to enable the batteries in the upper housing portion 52*a* to charge when the upper and lower housing portions are attached to each other. For example, the lower housing portion 52*b* may have a male charging connector that engages a female charging port on the upper housing portion 52*b* (or vice versa). As another example, the upper and lower housing portions may have corresponding magnetic inductance coils to enable wireless charging when the upper and lower housing portions are attached to each other. As yet another example, the upper and lower housing portions may have corresponding open charging contacts (which may be spring loaded on one or both of the upper and lower housing portions) that come in contact when the upper and lower housing portions are attached to each other. Optionally, the charging connection between the upper and lower housing portions may be integrated with the mechanical attachment mechanism used to securely attach the upper and lower housing portions.

Figure 17:
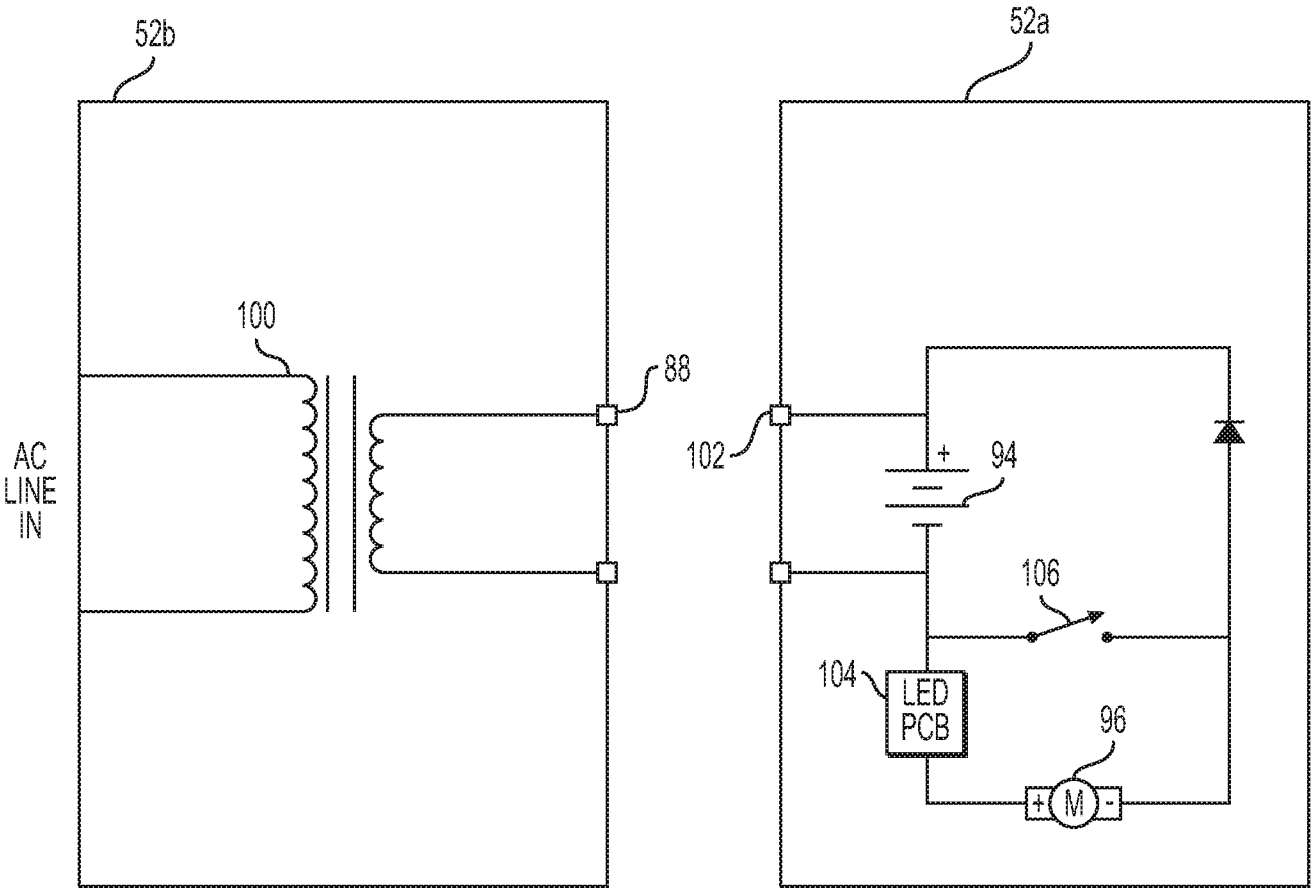
FIG. 17 is a block diagram of the electrical and control system of the electric can opener of FIG. 3.

As illustrated in the block diagram of FIG. 17 (the electrical connections are primarily illustrated schematically for simplicity), AC line voltage is received in the lower housing portion 52*b* via a power cord 66. The AC voltage is converted to DC voltage via a transformer 100, which may for example provide a 3 volt, 200 milliamp DC output to electrical contacts 88. The lower portion electrical contacts 88 project upward through holes defined in the floor 82 of the cavity 80. When the upper and lower housing portions 52, 52*b* are attached, the lower portion electrical contacts then also project through holes 78 defined in the floor 72 of the upper housing portion 52*a* and come in contact with upper portion electrical contacts 102, thereby providing DC power to the upper housing portion 52*a* to charge the battery 94. When a user depresses the handle 54, a switch 106 is closed to provide DC power from the battery 94 to the motor 96 to operate the can opener 50. A light emitting diode (LED) printed circuit board (PCB) 104 may provide an indication of charging status (e.g., blinking light if the battery is charging and solid light if the battery is fully charged).

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

That which is claimed:

1. An electric can opener comprising:

an upper opening portion and lower base portion, the upper opening portion and the lower base portion being selectively attachable to and separable from each other, the upper opening portion including a motor and one or more batteries to selectively power the motor and the lower base portion selectively provides electrical power to the upper opening portion to charge the one or more batteries when the upper opening portion and the lower base portion are attached;

a handle on the upper opening portion engaged to selectively lower a blade to pierce a can lid;

a drive wheel on the upper opening portion driven by the motor;

wherein the upper opening portion and the lower base portion are operable as an upright countertop electric can opener when selectively attached, the drive wheel rotating a can such that the can lid is cut by the blade; and wherein the upper cutting portion is operable as an electric walk-and-cut can opener when separated from the lower base portion, the drive wheel rotating the upper cutting portion and blade around a stationary can such that the can lid is cut by the blade;

a magnet mounted on a cantilevered arm extending from the upper opening portion, the magnet securing the cut can lid to the upper opening portion.

2. The electric can opener of claim 1, wherein the lower base portion selectively provides electrical power to the upper opening portion via corresponding electrical contacts in the upper opening portion and in the lower base portion.

3. The electric can opener of claim 1, wherein the lower base portion comprises an AC power cord and an AC-to-DC converter to provide DC electrical power to the upper opening portion.

4. The electric can opener of claim 1, further comprising one or more latches for selectively securing the upper opening portion to the lower base portion.

* * * * *